US005542649A

United States Patent [19]

Allegaert et al.

[11] Patent Number: 5,542,649

[45] Date of Patent: Aug. 6, 1996

[54] FENCE WITH MESH PANELS

[75] Inventors: Marnix Allegaert, Zwevegem; Steven Wostyn, Otegem, both of Belgium

[73] Assignee: N.V. Bekaert S.A., Zwevegem, Belgium

[21] Appl. No.: 319,106

[22] Filed: Oct. 6, 1994

[30] Foreign Application Priority Data

Oct. 21, 1993 [BE] Belgium ..... 09301121

[51] Int. Cl.[6] ..... E04H 17/10

[52] U.S. Cl. ..... 256/54; 256/47; 256/32

[58] Field of Search ..... 256/54, 52, 47, 256/48, 55, 56, 49, 50, 32, 33, 21, 22, 24, DIG. 3, DIG. 5; 24/563, 679, 545; 403/391, 397

[56] References Cited

U.S. PATENT DOCUMENTS

| | | | |
|---|---|---|---|
| 221,878 | 11/1879 | Taylor | 256/56 |
| 892,420 | 7/1908 | Harmon | 256/56 |
| 973,576 | 10/1910 | Smail | 256/48 |
| 1,407,540 | 2/1922 | Holsinger | 256/48 |
| 4,553,740 | 11/1985 | Bailey | 256/33 |

FOREIGN PATENT DOCUMENTS

| | | | |
|---|---|---|---|
| 130674 | 12/1948 | Australia | 256/48 |
| 0368778 | 5/1990 | European Pat. Off. . | |
| 1352736 | 1/1964 | France | 256/49 |
| 2641306 | 7/1990 | France . | |
| 2686640 | 7/1993 | France | 256/32 |
| 2645905 | 4/1978 | Germany | 256/25 |
| 2820954 | 11/1979 | Germany | 256/24 |
| 4005160 | 8/1991 | Germany | 256/47 |

*Primary Examiner*—Brian K. Green
*Assistant Examiner*—Harry C. Kim
*Attorney, Agent, or Firm*—Foley & Lardner

[57] ABSTRACT

A fencing section comprises a rod panel which is attached in the edge zone on both sides to an adjacent post in a number of attachment points by using of an attachment device. Such a device has a frontal part and a side part containing a horizontal groove wherein a horizontally extending section of the mesh panel runs. For a first part number the groove is located in the upper surface of the device, and for the other part number in the lower surface of the device. The device has a stud in its frontal part that fits into an opening in a frontal vane of the post. In at least one of the two part numbers, the device is elastically deformable. Such a fencing section is easy to assemble, but is extremely difficult to dismantle by vandalism.

16 Claims, 5 Drawing Sheets

FIG.1
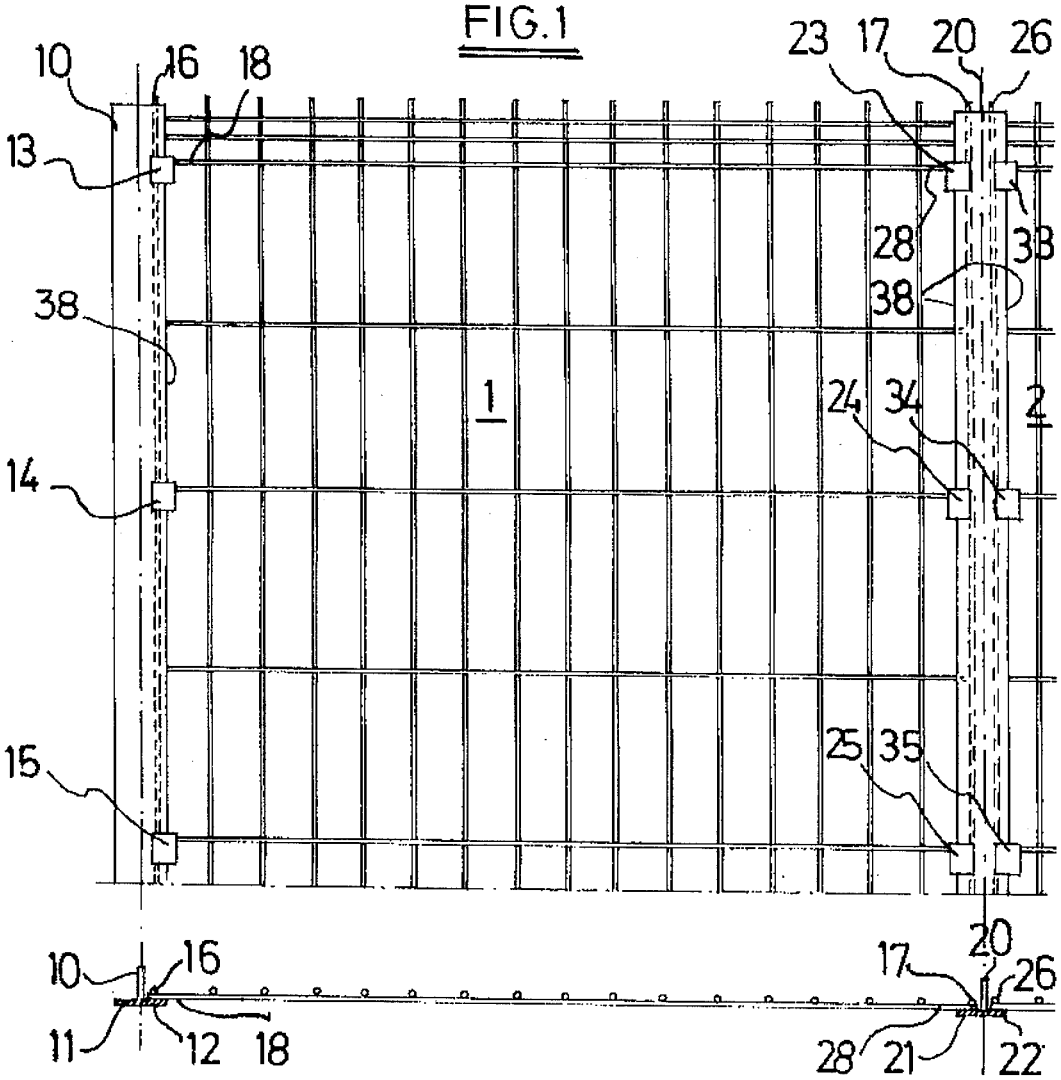
FIG.2
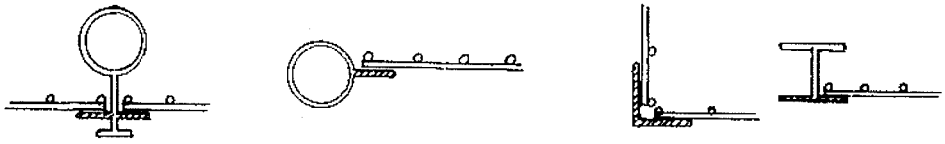
FIG.3

FENCE WITH MESH PANELS

BACKGROUND OF THE INVENTION

The invention relates to a fencing section comprising a rod panel having, at each of the vertical sides thereof, an edge rod with a vertical course, and further comprising at each of both vertical side edges, an adjoining fence post to which the corresponding side edge is attached. Such a section can of itself be used to close something, but generally constitutes part of a fence consisting of a row of posts arranged with a rod panel mounted between every two posts. A "fencing section" here is regarded as being the rod panel element with the posts on both sides, irrespective of whether it constitutes part of a larger whole or forms an independent unit.

The rod panel is a grille of metal rods arranged in a mesh structure, not necessarily in the same plane, but with mesh dimensions which are small enough and metal rods which are thick enough, taking account of the mesh width, to induce sufficient rigidity and strength in the whole structure, so that, at any rate, they cannot be deformed with the naked hand, for example comprising drawn steel wires with a round section and a thickness of between 3 and 8 millimeters. The rods are strongly attached to each other at the intersections of the mesh, preferably by means of welding, and the whole is preferably coated with a corrosion-resistant plastic such as PVC or nylon.

Fences with rod panels are often used in cases where vandalism is possible. It is therefore necessary to pay special attention to ensuring that the panels are extremely firmly attached to the posts and are difficult to dismantle, at least from one side, namely the side from which the vandalism is expected. Thus one side of the section will be regarded as the "front side" and the means of attachment will be structured thereon in such a way that it is difficult to dismantle, at least from that front side. The front side thus chosen then defines the terms "front" and "rear" for the entire structure as described hereinafter.

In a known embodiment in accordance with FR 2.641.306, each of the vertical side edges of the rod panel is attached in a number of attachment points at various heights on the post. The attachment at each of these points is formed by a frontal (i.e. parallel with the panel) plate-shaped vane which constitutes part of the post and against the rear side of which the adjacent vertical side edge of the rod panel rests, and by an attachment device mounted on that vane. In such attachment device, a frontal part rests with its rear side against the front side of the vane and a side part extends backwards past the side edge of the vane and contains a horizontal groove wherein a rod section runs that extends horizontally towards the aforementioned vertical edge rod. This latter fact thus implies that the side part of the attachment device extends backwards over a sufficient distance, past the thickness of the vane and beyond, so as offer sufficient space for this groove. For a first part number of these attachment points of a vertical side edge, the groove in which this rod section runs is located in the upper surface of that side part, and in the remaining part number it is located in the lower surface. This latter is necessary in order to ensure that the panel cannot be simply lifted out of the attachment within its own plane, as will become apparent later.

A number of horizontal or inclined rods extend to each vertical edge rod of the panel, and are attached to that edge rod at the intersections, preferably by welding. The rod which extends at the location of the attachment point must have an end which extends in a horizontal direction, at least along a section just before it reaches that intersection, because this part must be able to run in the horizontal groove of the attachment device. It is this section which is meant here by the expression "rod section extending horizontally to the edge rod".

In this known embodiment the attachment device is fabricated from metal and contains a rear part which runs on the rear side of the frontal vane. The device is attached to the post by clamping the frontal part, which rests against the front side of the frontal vane, to the front plate by means of a screw which is screwed into an opening in the rear part of the device until it strikes the rear side of the front plate and is pressed against the rear side of the frontal vane. In this way removal of the screw from the front side is made very difficult. This securing with a screw demands particular care in positioning, however, and also requires screwing work. Moreover, even when the screw has been screwed in from the rear side, at vandalism, this structure can still be unscrewed with a certain degree of dexterity.

SUMMARY OF THE INVENTION

The purpose of the invention is to provide a fencing section which is difficult to dismantle and which can be assembled with a minimum of work and time without positioning problems.

According to the invention, the attachment device, in each of the aforementioned number of attachment points, has a shape that can be slipped frontally onto the vane, without the panel, and, on the aforementioned rear side of its frontal part, it has a protruding stud which fits into an opening in the vane, without play, and furthermore this attachment device is elastically deformable for at least one of the two part numbers of attachment points (that is, either the part number with the groove in the upper surface of the side part or the part number with the groove in the lower surface), whereby insertion of this attachment device onto the vane, with panel present, includes an elastic deformation of the device.

Such a panel can then be assembled extremely simply: in a first step all attachment devices of the first part number, which must have a groove on the upper surface, are slipped frontally onto the two posts, still without panel, with the stud in the opening. Thus no positioning or screwing is required. In a second step, the panel is hung in the attachment devices thus positioned, with the rod sections extending horizontally to the edge rod lying in the corresponding grooves. And in a third step, all attachment devices of the second part number, which must have the groove on the lower surface, are pushed into the two posts under elastic deformation.

The successive sections of a fence can also be positioned in the sequence: post, panel, post, panel, and so on. In this case a first post is first planted in the ground on one side. One side edge of a panel is then affixed to this post, by first frontally inserting the first part number of attachment devices, then placing the panel in the grooves, and then pushing in the second part number of attachment devices. The panel then remains temporarily hanging by this one side edge on the first post. A second post is then planted in the ground at the correct distance, and finally the second side edge is affixed to it. Care can be taken that the attachment of the first side edge to the first post has sufficient play to allow all attachment devices of the first part number to be inserted frontally in the second post while the panel is lifted slightly, after which it is lowered into the grooves and the second part number of attachment devices are then pushed in.

Preferably, the part number of attachment points, having the groove on the lower surface, is chosen to be equal to one on both sides of the panel, and, at least for such attachment point on both sides, the attachment device is elastically deformable. Then only one device needs to be pushed in elastically on each post, and all others are simply slipped in in advance.

During elastically pushing in, there is an initial elastic deformation resistance which has to be overcome, but eventually the device jumps to the desired position on its own accord, where the device once again assumes an undeformed state. This pushing in is thus a form of "snapping". The device can be made from a relatively hard plastic so that this snapping in requires a good deal of force, so that this must be effected using pliers or other specific tool, and so that "snapping out" with the naked hand is impossible or very difficult. It is also possible, in order to facilitate placing, to ensure that the snapping in and snapping out operations are less difficult with, if required, additional measures being taken to prevent snapping out. In addition, the configuration of the attachment, that is the shape and position of the vane, groove and stud can be further adjusted in a manner that makes snapping in relatively easy and snapping out extremely difficult. Thus, for example, a stud and opening can be used with a barbed hook system between the two, or a stud whose end extends further than the opening and which has a shape that springs open when that end has passed through the opening and emerges on the other side.

Once the attachment devices are in position on the fence, it is moreover difficult to see from the front side how the device is secured, because no screws are visible. Moreover, measures can be taken to ensure that, on the rear side of the vane, the vertical edge rod runs over the opening, so that this opening with stud is difficult to reach with a tool.

BRIEF DESCRIPTION OF THE DRAWINGS

The invention will now be explained in more detail on the basis of a number of drawings.

FIG. 1 shows a fencing section upon which the invention will be applied;

FIG. 2 shows the same fencing section, in plan view;

FIG. 3 shows a number of post sections which can be used with the invention;

FIG. 11 shows the same attachment device after snapping in;

DETAILED DESCRIPTION OF THE PREFERRED EMBODIMENTS

Figure 4:
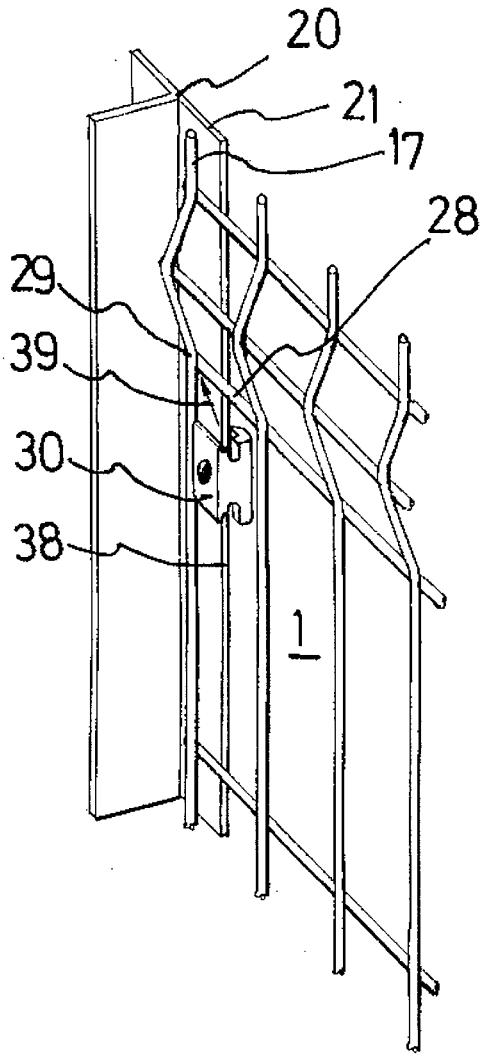
FIG.4 (PRIOR ART)
FIG. 4 shows an attachment point with an attachment before application of the attachment device, and according to prior art.

FIG. 1 shows a fencing section with a rod panel 1 and with a vertical side edge on both sides and an adjacent fencing post 10, and 20, respectively, to which the corresponding side edge is attached. On the right side of the drawing there is an adjoining second similar fencing section with a rod panel 2 and on both sides, a post 20, respectively a post which is not shown on the drawing. The post 20 is common to both adjacent sections, and the adjacent vertical side edges of the panels 1 and 2 are attached to this side edge.

FIG. 2 shows a plan view of the same fence. It can be seen here that the posts have a T-section, each with two frontal vanes 11, 12 and 21, 22 respectively (shaded). It will become apparent from what follows that any section can be used, in so far as it has a frontal plate-shaped vane along the side where a panel is to be attached (usually on both sides), to which the panel must be able to be attached. Thus FIG. 3 shows a number of possible sections, with a single vane, with two vanes in the prolongation of each other, with vanes arranged at an angle for use with corner posts, or with vanes arranged in an I-section. The term "frontal plate-shaped vane" is thus used here to refer to a plate-shaped part, parallel to the adjoining panel, but not necessarily on the front side of the post (in FIG. 2 the front side is the bottom of the drawing), although the latter is generally to be preferred with a view to making it difficult to break off the structure from the front side.

The adjacent vertical side edges of the rod panels are attached to each of these posts in a number of attachment points at various heights on the post. Thus in FIG. 1 the left-hand side edge of the panel 1 is attached to the post 10 in the attachment points 13, 14 and 15 and the right-hand side edge to the post 20 in the attachment points 23, 24 and 25, while the left-hand side edge of the panel 2 is attached to the same common post 20 in attachment points 33, 34 and 35.

As can be seen from FIG. 2, the rod panel 1 comprises a vertical edge rod 16 or 17, respectively, on each of its vertical side edges. This is also the case for the panel 2, whereby the edge rod 26 can be seen in FIG. 2. Each of both vertical side edges of panel 1 is mounted against the rear side of the respective adjacent frontal vane 12 and 21 of the adjacent post 10 and 20.

The rod panel 1 according to FIGS. 1 and 2 consists of horizontal rods and vertical rods which are firmly attached to each other at the intersections, preferably by means of welding, to form a grille with right-angled meshes. It will become apparent from what follows that the choice of the orientation of the rods and the configuration of the meshes is completely free in regard to the application of the invention, with the exception of the locations of the attachment points 13 to 15 and 23 to 25. At these locations the course of the edge rods 16 and 17 must be vertical (not strictly geometrical) and a rod end 18, 28 with a horizontal course (not strictly geometrical) must be attached to that edge rod, preferably by means of welding, whereby the rest of this rod may also be horizontal, as shown in FIG. 1, though this is not necessary. The rest of the edge rod also need not be strictly vertical, in so far as the edge rod itself has a vertical course, which joins the rod sections that end on the vertical side edge to each other, so that a strong side edge is obtained. Thus the rods can be bent partially out of the plane of the panel, or can be corrugated. The rods themselves should preferably be fabricated from drawn steel wire, preferably with a round section, although triangular sections, for example, are also possible.

Mention has already been made of the fact that a section will be used for the posts 10 and 20 which, at least along the side where a panel has to be attached, has a frontal plate-shaped vane, e.g. vane 12, for the attachment of the edge of the panel 1 to the post 10. In the strict sense, this frontal vane is only necessary at the location of the attachment points, and could be omitted between the attachment points. In this latter case each attachment point then has its own individual frontal plate-shaped vane, where the vertical side edge of the panel is mounted against the rear side of that individual vane at that location. A common vane 12 for all attachment points 13 to 15 of the same vertical side edge is preferred, however, both from the point of view of the manufacture of the post section and for the rigidity of the whole attachment of the side edge. For a post 20 where the two adjacent panels 1 and 2 are both in the prolongation of each other, the two adjacent vanes 21 and 22 should preferably also be in the prolongation of each other (FIG. 2) so as to form one single frontal strip-formed section of the post, which runs continuously from top to bottom, as in the T-section shown.

As already stated, at the location of each attachment point, for example 13 to 15, the corresponding vertical side edge is mounted against the rear side of the respective adjacent individual or common plate-shaped vane 12. This does not mean that it is then necessarily the vertical edge rod 16 or the horizontal rod end 18, that rests against this rear side. In the case of rods which are welded onto each other as shown in FIG. 2, it is however preferable, for the attachment in accordance with the invention, that the horizontal rod end 18 should run in front of the vertical edge rod 16, because the attachment device can then have a shorter and stronger side part. Mounting in the groove in accordance with the invention will be such that this resting is effected without play.

Figure 5:
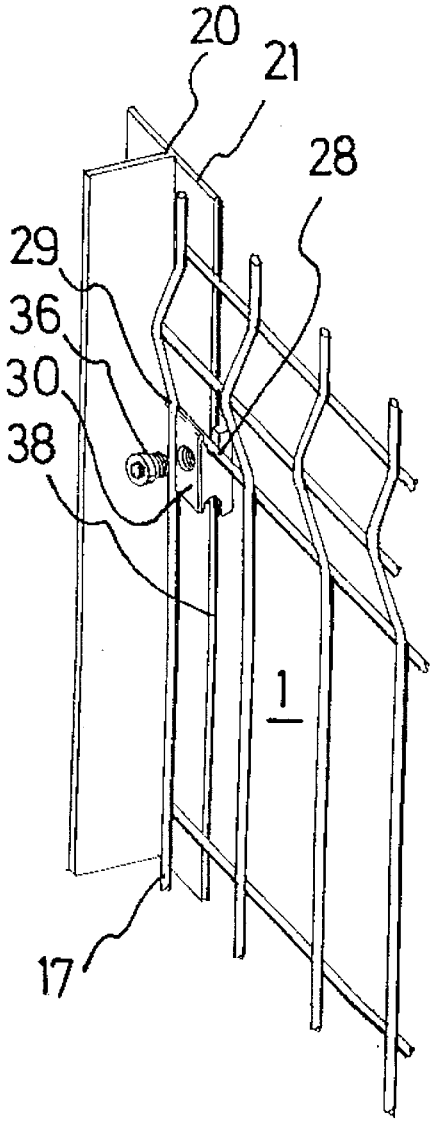
FIG.5 (PRIOR ART)
FIG. 5 shows the same attachment point after the attachment device has been placed in position.

FIGS. 4 and 5 show a detail drawing of the attachment point 23 from FIG. 1 and of the method known until now of attaching the vertical side edge to the vane 21 of post 20. The attachment is shown, as can be seen, from the rear side of the panel 1. The edge rod 17 can be seen on the figures, which has a vertical course at the location of the attachment point, and where the rod end 28, with a horizontal course, is welded in a corner point 29. This rod end can if required extend beyond this corner point for a short distance.

Attachment takes place by means of an attachment device 30 which is a single coherent metal piece. In FIG. 4 the panel 1 has already been placed in position, but the attachment device 30 has not. It is placed in position by pushing it in, over the edge 38 of the vane 21 in the direction of the arrow 39, until it reaches the position as shown in FIG. 5.

Figure 6:
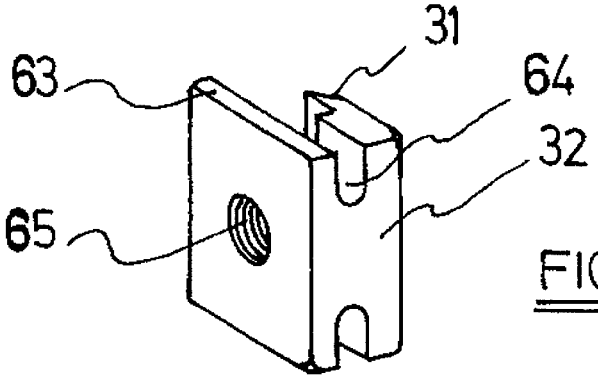
FIG.6 (PRIOR ART)
FIG. 6 shows a detail of an attachment device in accordance with the state of the art.

A detail drawing of such an attachment device is shown in FIG. 6. The device comprises a frontal part 31, a side part 32 with a horizontal groove 64 in the upper surface thereof, and a rear part 63. As shown in FIG. 5, when the device 30 is in position, the frontal part 31 rests against the front side of the vane 21, the side part 32 runs past the edge 38 of the vane 21 from the front to the rear, the horizontal rod end 28 lies in the groove 64, and the rear part 63 rests against the rear side of the horizontal rod end 28. In the position in accordance with FIG. 5, this device 30 is then screwed to the vane 21 by means of a screw 36 which is screwed in from the rear side into an opening 65 in the rear part of the attachment device 30. The screw is screwed in until the end thereof presses firmly against the rear side of the vane 21.

The other attachment points 24 and 25 (FIG. 1) on the same post 20 as well as, but then symmetrical with respect to a central vertical line in the panel 1, the attachment points 13 to 15, comprise a similar attachment to that shown for the attachment point 23 as shown in FIGS. 4 to 6. However, if they all have a form of attachment whereby the groove 64 is located in the upper surface of the side part 32 of the attachment device 30, and wherein the corresponding horizontal rod end 28 lies, then it is clear from FIGS. 1 and 5 that the entire panel 1 can be lifted out of the grooves by the two vertical side edges and removed. Therefore, at least one of the attachment points on each vane 12, 21, will have an attachment device with a groove on the lower surface of the side part 32, wherein then the corresponding horizontal rod end 18 or 28, respectively, lies. The panel can then not be removed either upwardly or downwardly and is located securely.

Figure 7:
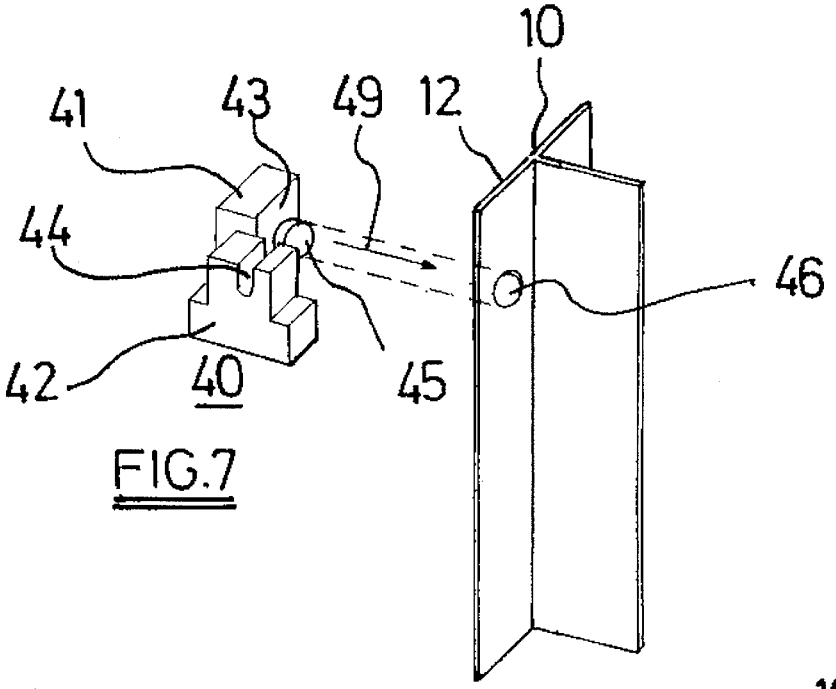
FIG. 7 shows the first step of the assembly, whereby an attachment device in accordance with the invention is slipped frontally onto the vane on the post.
Figure 8:
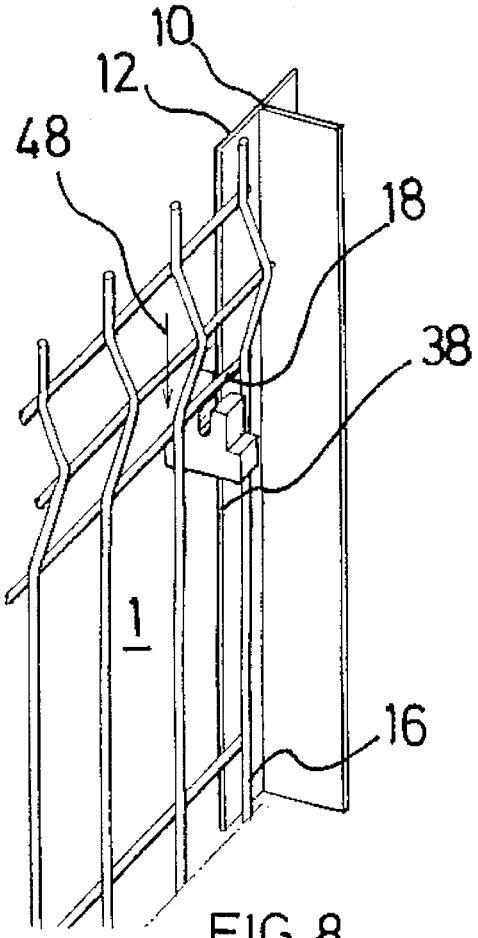
FIG. 8 shows the second step, whereby the panel is lowered into the grooves.
Figure 9:
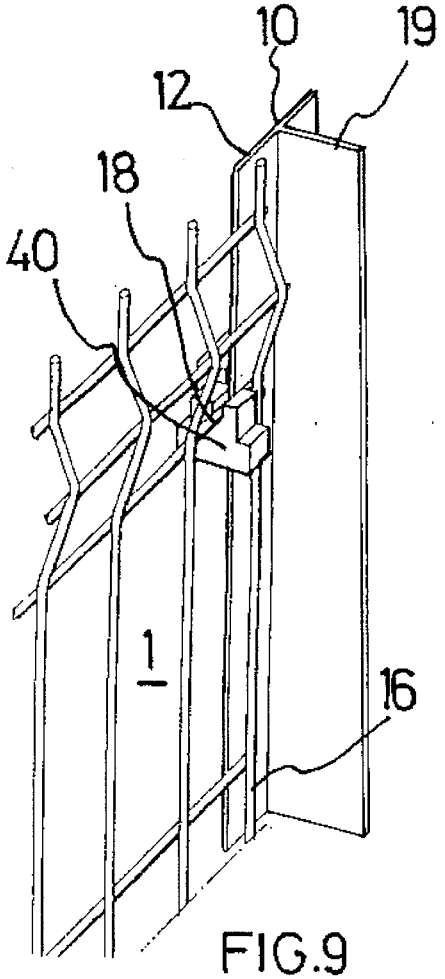
FIG. 9 shows the position of the panel in the attachment device after lowering.

FIGS. 7, 8 and 9 now show a detail drawing of the attachment point 13 from FIG. 1 and of the method of attachment, in accordance with the invention, of the vertical side edge to the vane 12 of the post 10. Here again the attachment is seen from the rear side of the panel 1. FIG. 7 shows the attachment device 40 before it is applied to the post 10 by slipping in frontally onto the post without panel, that is to say by a translation movement which is perpendicular to the vane 12 as indicated by the arrow 49. This attachment device again comprises a frontal part 41 and a similar side part 42 with a horizontal groove 44 in the upper surface thereof, but has no rear part, since otherwise the device could not be slipped in frontally onto the vane 12. The frontal part 41 has a contact surface on the rear side 43, which is intended to rest against the front side of the vane 12 when the device is slipped onto the post. On this rear side 43 the frontal part contains a stud 45 which fits without play into an opening 46 in the vane 12.

During assembly the attachment device 40 is first slipped onto the post 10, as shown in FIG. 7, in the direction of the arrow 49, with the stud 45 in the hole 46, until the contact surface of the aforementioned rear side 43 strikes against the front side of the vane 12. The device is at this stage not yet securely attached to the post and can be immediately withdrawn. But the device becomes secure thereafter, without use of a screw or screw thread, because the panel I is thereafter lowered into position, in the direction of the arrow 48 (FIG. 8), until the panel comes into the position shown in FIG. 9. The rod end 18 is then located in the groove 44, without play in a forward or backward direction, and withdrawal of the stud is no longer possible. Thus the need for screw and screw thread is eliminated, a rear part is no longer necessary for the attachment device and frontal pushing in of the device into the post in advance becomes possible, without the need for either work or positioning.

In the attachment points 13 to 15 (FIG. 1) and the symmetrical embodiment thereof for the attachment points 23 to 25, all attachment devices can thus in advance be slipped onto the respective vanes 12 and 21 of the posts 10 and 20 with the grooves on the upper side, and the panel 1 thereafter lowered into those grooves. It is clear, however, that with such an arrangement the panel 1 could then equally easily be lifted up again. In this embodiment too, therefore, at least one of the attachment points on each vane 12, 21 will have such an attachment device, but with the groove on the lower side. Normally, however, assembly of such an arrangement is not possible.

This is because, if all attachment devices are positioned in advance, both those with the grooves facing upwards and those with the grooves facing downwards, the panel can no longer be lowered into those grooves of those attachment devices, because there are some devices with the grooves on the lower surface. However, if only those attachment devices are positioned wherein the groove faces upwards, the panel can be lowered into these grooves, but then the attachment devices with the grooves facing downwards must be positioned on the post with the panel already in place. This is no longer possible, however, since the horizontally extending rod section 18 is in the way.

Figure 10:
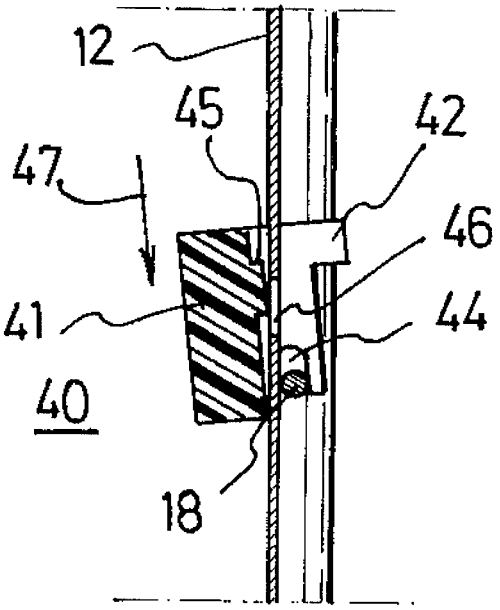
FIG. 10 shows an attachment point in side view, and the third step of the assembly, before the snapping in of the attachment device.
Figure 11:
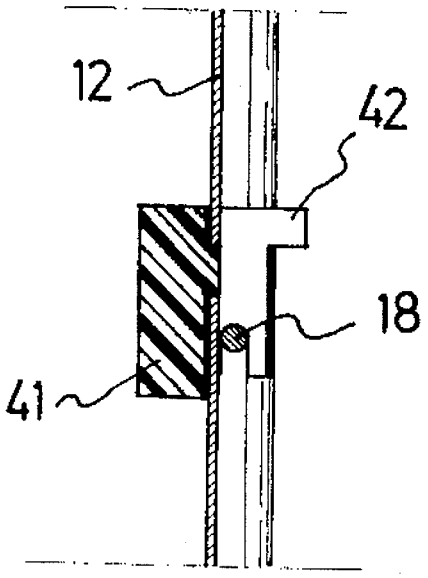

There is a solution, however, if the attachment devices which have to be placed in position after lowering of the panel are fabricated such that they are elastically deformable, for example being fabricated completely from elastically deformable material, for example from plastic. FIGS. 10 and 11 show how such a device 40 is thereafter attached to the vane 12 of the post 10. In these figures the direction of view is that of the horizontal wire end 18, where only the round cross-section is visible, and the vane 12 is also visible only in the thickness, in cross-section at the location of the opening 46. The frontal part 41 of the device is shown in vertical section at the location of the stud 45, and the side part 42 is shown in profile. The device is placed in a position with the horizontal wire end 18 already partially located in the groove (FIG. 10). The stud 45 is then not correctly positioned with respect to the hole 46. The device is pressed in the direction of the arrow 47, however, whereby it undergoes elastic deformation and ultimately jumps into the position as shown in FIG. 11, with the stud in the hole and with the horizontal wire end 18 located in the groove to its full depth. The higher the modulus of elasticity of the plastic (for example a fibre-reinforced polyamide), the more difficult it is to push the device into position, and also to withdraw the device from its position. The shape and mutual positions of the vane 12, stud 45 and groove 44 can then be chosen in such a way as to make withdrawal as difficult as possible. It is then possible that elastically pushing in of the device is possible Without breakage, but that elastic withdrawal without breakage is no longer possible: as in barbed hook systems, reverse movements do not always cause the same deformations. The shape and mutual positions of the vane 12, stud 45 and groove 44 can also be chosen such that, for example by using a groove which is wider at the surface than at the deepest point (more V-shaped than U-shaped), snapping in and out under slight elastic deformation is made much easier and that positioning is thus easier, but whereby the device is then protected against withdrawal by means of a closing piece as described hereinafter.

Figure 12:
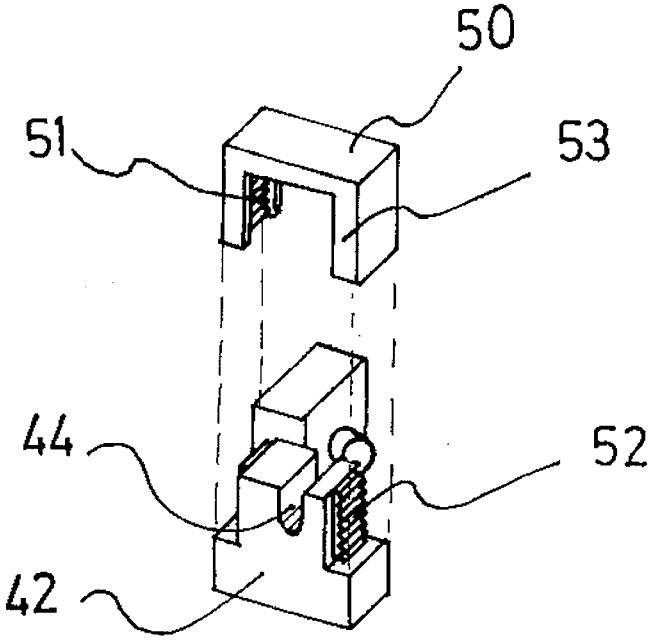
FIG. 12 shows a detail view of an attachment device according to the invention, with a U-shaped closing piece which is pushed over the side part thereof.

Withdrawal of the attachment device can in any event be made much more difficult by providing the grooves 44 with a U-shaped closing piece 50 (FIG. 12) which is pushed over the side part 42 over a reverse toothed system towards the groove in a direction which is perpendicular to the groove, so that the latter is sealed. The reverse teeth 51 on the inner surface of the closing piece engage with the teeth 52 on the section of the surface of the side part 42 along which the closing piece 50 is pushed on the side part 42. This engagement takes place in such a manner that pushing outwards in the opposing direction is no longer possible without breakage. It must also not be possible that this closing piece 50 could be pushed off in the direction of the groove. Therefore the closing piece 50 and the side part 42 are matched to each other in terms of shape in such a way, for example with an edge 53 on the closing piece, that pushing off in this way is prevented by the fact that the closing piece, for example with this edge, strikes against this side part.

As will be clear from the explanation above, mounting of the panel 1 (FIG. 1) will be possible from the moment that there are a number of attachment points on each side edge (e.g. three : 13, 14 and 15), whereof the first part number (e.g. two: 13 and 14) have the groove in the upper surface of the side part of the corresponding attachment device, and the remaining part number (e.g. one: 15) in the lower surface. Although the reverse arrangement is also possible, the first number of attachment devices with the groove facing upwards are first positioned in advance on the posts 10 and 20, the panel 1 is then slided down vertically into the grooves, and the remaining part number of attachment devices are then attached to the posts with the panel already assembled, by means of elastic deformation. Preferably, this remaining part number should be equal to one. Strictly speaking, therefore, it is only one of the two part numbers, namely the part number which is positioned in the post last, in which the attachment device must be vertically deformable. Preferably, however, for the sake of simplicity of manufacture and use, all devices will be fabricated in the same elastically deformable embodiment.

It is also possible to ensure, again for the sake of simplicity of manufacture and use, that all attachment devices, both those (13 to 15) on the one side edge and the symmetrical embodiment on the other side edge (23 to 25), are of the same shape. It is then sufficient that the devices are symmetrical in shape with respect to a horizonal plane through the middle of the device (an equatorial plane). This was already the case, for example, for the devices in accordance with FIG. 6. In that case the side part has a horizontal groove in both the upper surface and the lower surface.

Figure 13:
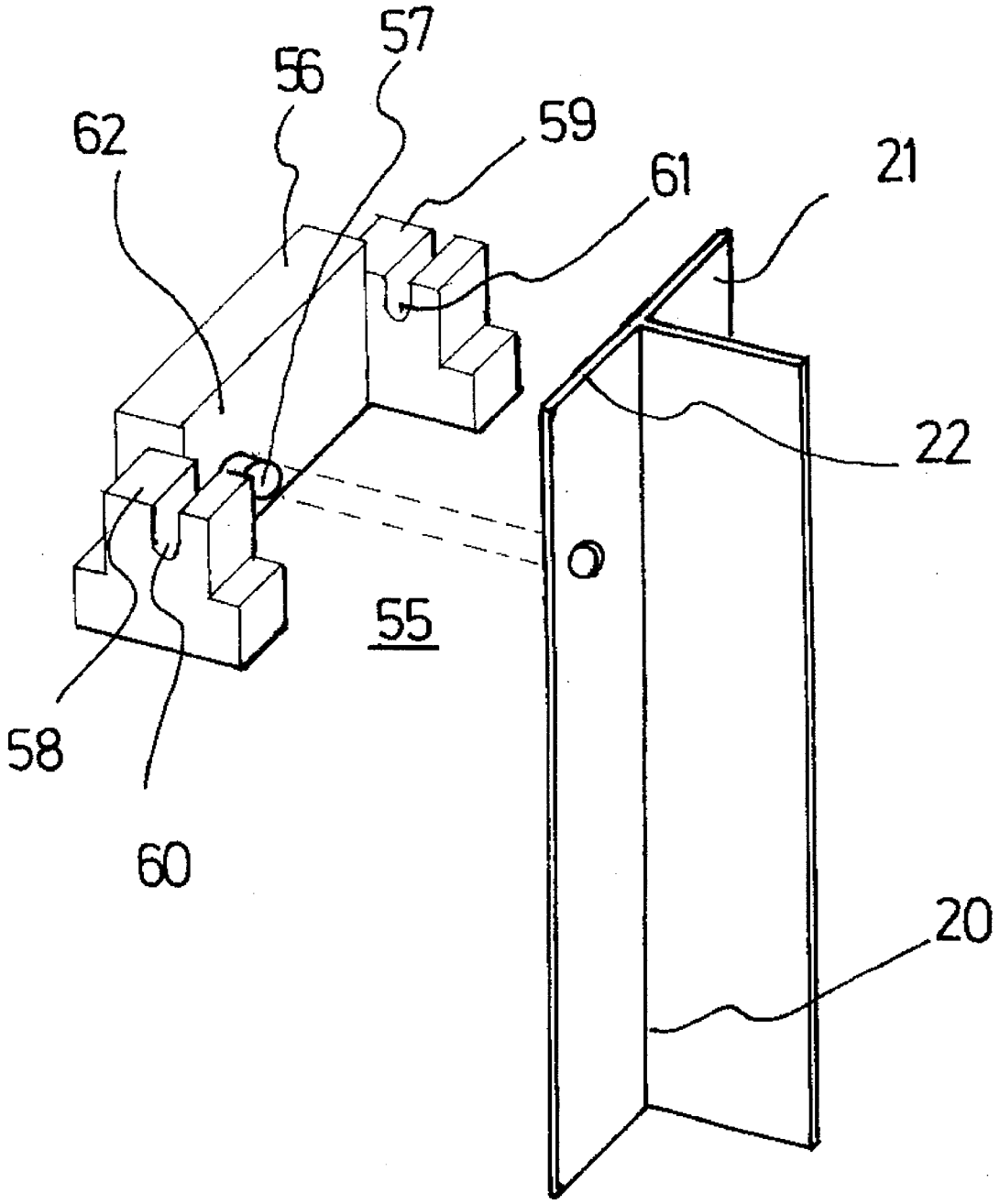
FIG. 13 shows a detail view of an attachment device which is common for the attachment of two panels on both sides of a post.

For a post 20 (FIG. 1) whereby both adjacent panels 1 and 2 lie in the prolongation of each other, the two adjacent vanes 21 and 22 should preferably also lie in the prolongation of each other. The attachment points 23 and 33, 24 and 34 and 25 and 35, respectively, should then preferably be positioned in pairs two by two at different heights on the post, although this arrangement in pairs is not strictly necessary. If this is the case, however, a common attachment device 55 can be provided for each such pair as shown in FIG. 13. Such a device consists of a common frontal part 56 with a common stud 57 and two side parts 58 and 59 on either side, with the horizontal grooves 60 and 61 lying in the prolongation of each other. This device can be slipped frontally onto the plate, consisting of the vanes 21 and 22, until the contact surface 62 rests against the front side of that plate. Preferably, this device should be symmetrical (with the possible exception of the stud) with respect to a vertical plane perpendicular to the vane, and through the middle of the device. The same device can then be reversed for use with the grooves facing downwards.

Since the attachment device 40 (FIG. 7) has no rear part, play can arise in front of the edge rod 16, between the side part 42 of the attachment device and the central vane 19 of the post 10 (FIG. 9). As a result thereof, a small amount of horizontal movement in the plane of the panel is possible. However, this means that it is not necessary to plant the post 10 at an extremely accurate distance from the post 20. The play can serve to take up inaccuracy when positioning.

Further embodiments can be derived from this explanation which are based on the same principle: an attachment device without rear part which can be slipped frontally onto a vane of a post, and positioning a stud in the frontal part with respect to the vane and the groove such that pushing in without elastic deformation is not possible, but pushing in with elastic deformation is. The stud 45 fits into the opening 46 without play, but this stud need not be round for this purpose. It can in particular be square, and the rear side 43 of the frontal part can contain more than one stud. In addition, the attachment device need not be fabricated entirely from elastically deformable material, in so far as the device of itself possesses the necessary elastic deformability at the required locations for snapping in. Moreover, the vanes 12, 21 at the attachment points need not necessarily have a flat plate form with an equal thickness at all locations, in so far as the attachment device at the front and the side edge of the panel at the rear can rest against it. Thus this vane can for example be provided with a nose section, as shown in FIG. 3. The shape of the attachment device must then be adapted thereto, preferably though not necessarily in such a way that the rear side of the frontal part not only rests against the front side of the post, but also has as much contact as possible with the front side.

We claim:

1. Fencing section comprising:

a rod panel having an edge rod extending vertically at each lateral side thereof and a plurality of vertically spaced laterally extending rods between the edge rods;

a fencing post for each s lift edge rod, each poet having a vertically extending plate-shaped vane having a first side adapted to rest against one of the edge rods, a second side, and a plurality of vertically spaced apart openings;

a plurality of attachment devices at vertically spaced locations along the fencing posts for attaching the rod panel to the fending posts, each attachment device including a frontal part having a face adapted for resting against the second side of the vane and a side part connected to the frontal part, the side part having a portion extending from the frontal part past the first side of the vane upon attachment thereof to the fencing post, wherein the side part of each said attachment device has a horizontal groove for engaging one of the laterally extending rods, wherein the horizontal groove in at least one of the attachment devices is located in an upper region of the side part, and the horizontal groove in the other one of the attachment devices is located in a lower region of the side part, wherein each said attachment device has a protruding stud extending from the face of the frontal part for receipt without substantial play in one of the vane openings, wherein each said attachment device is configured to be slipped frontally onto the vane without the panel, and wherein at least one of the attachment devices is elastically deformable so that attachment of the at least one attachment device to the vane with the panel requires an elastic deformation of the attachment device.

2. Fencing section according to claim 1, wherein the elastically deformable attachment device has the horizontal groove formed in the lower region of the side part.

3. Fencing section according to claim 1, wherein all of the attachment devices have a same configuration and are elastically deformable.

4. Fencing section according to claim 1, wherein each of the plate-shaped vanes of the fencing poets comprises at least first common vertically extending plate shaped vane with the second side being formed therebehind.

5. Fencing section according to claim 4, wherein at least one of the fencing posts shares a pair of edge rods of adjacent pair of rod panels and further includes a second vertically extending plate-shaped vane adjoining the first vane for accommodating another rod panel, wherein the first and second adjoining vanes lie in the prolongation of each other and wherein the adjacent rod panels lie in the prolongation of each other, with the adjacent vertical edge rods of the adjacent panels attached to the same post.

6. Fencing section according to claim 5, wherein at least one of the attachment devices has a common frontal part with a common protruding stud for engaging the opening in the first vane and two side parts on both ends of the frontal part, the side parts extending from the frontal part and past the first side of the first and second vanes, wherein each of the side parts has a horizontal groove for engaging one of the laterally extending rods of the adjoining rod panels, wherein the horizontal grooves thereof lie in the prolongation of each other.

7. Fencing section according to claim 1, wherein at least one of the side parts of the attachment devices has a U-shaped closing piece for enclosing the horizontal groove, wherein the side part includes barbed hooks and the closing piece includes complementary barbed books, which hooks of the closing piece and the side part form a lock to prevent the closing piece from coming off the side part in the direction perpendicular to the hooks.

8. Fencing section according to claim 6, wherein the hooks are generally parallel to the groove and wherein the closing piece is pushed over the side part over the barbed hooks in a direction toward the groove, perpendicular to the groove, wherein the closing piece also includes means for locking the closing piece in the direction parallel to the groove.

9. Fencing section comprising:

a rod panel having at least one portion defined by an edge rod extending in one direction and a plurality of side rods extending at an angle from the edge rod;

a fencing post having a first plate-shaped vane, which has a first side adapted for resting against the edge rod and a second side opposite the first side, the vane having a plurality of spaced apart openings;

at least two attachment devices for attaching the rod panel to the fencing post, each attachment device including a frontal part having a face adapted for resting against the vane second side and a side part connected to the frontal part, the side part having a portion extending from the frontal part past the vane first side upon attachment thereof to the fencing post, wherein the side part of each said attachment device has a first side and a second side opposite the first side, and a groove for engaging one of the side rods, wherein the groove of one of the attachment devices is located in the first side of the side part end the groove of the other one of the devices is located on the second side of the side part, wherein sachet it attachment device has a protruding stud extending from the face of the frontal part for receipt without substantial play in one of the vane openings, wherein at least one of the attachment devices is configured to be connected to the vane without the panel and wherein one of the attachment devices is configured to be connected to the vane along with the panel.

10. Fencing section according to claim 9, wherein the attachment device configured to be connected to the vane with the panel is elastically deformable, wherein insertion of the stud into one of the vane openings and seating of one of the side rods onto the groove of the side part require elastic deformation of the attachment device.

11. Fencing section according to claim 9, wherein all of the attachment devices have a same configuration and all are elastically deformable.

12. Fencing section according to claim 9, wherein at least one of the side parts of the attachment devices has a U-shaped closing piece for closing the groove, wherein the side part includes barbed hooks and the closing piece includes complementary barbed hooks, which hooks of the closing piece and the side part form a lock to prevent the closing piece from coming off the side.

13. Fencing section according to claim 12, wherein the hooks are generally parallel to the groove and wherein the closing piece is pushed over the side part over the barbed hooks in a direction perpendicular to the groove, toward the groove to close the groove, wherein the closing piece also includes means for locking the closing piece in the direction parallel to the groove.

14. Fencing section according to claim 9, wherein the fencing poet further includes an adjoined second plate-shaped vane contiguous with the first vane for accommodating another adjacent rod panel lying in the prolongation with the rod panel, with the adjacent edge rods of the adjacent panels attached to the same post.

15. Fencing section according to claim 14, wherein at least of the attachment devices has a common frontal part with a common protruding stud for engaging the opening in the first vane and two side parts attached to both ends of the frontal part, the side parts extending from the frontal part and past the first side of the first and second vanes, wherein each of the side parts has a groove for engaging one of the side rods of the adjoining rod panels, wherein the grooves thereof lie in the prolongation of each other.

16. Fencing section according to claim 14, wherein the edge rod and the side rod extend substantially perpendicularly to each other.

* * * * *

UNITED STATES PATENT AND TRADEMARK OFFICE

CERTIFICATE OF CORRECTION

PATENT NO. : 5,542,649

DATED : August 6, 1996

INVENTOR(S) : Marnix ALEGAERT et al.

It is certified that error appears in the above-indentified patent and that said Letters Patent is hereby corrected as shown below:

Column 9, line 21, Claim 1, "s lift" should read -- said--

Column 9, line 59, Claim 4, "poets" should read --posts--;

Column 10, line 52, Claim 9, "sachet it" should read -- each said --;

Column 11, line 7, Claim 12, after "side" insert -- part--;

Column 11, line 16, Claim 14, "poet" should read --post--;

Signed and Sealed this

Twenty-eighth Day of January, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,542,649

DATED : August 6, 1996

INVENTOR(S) : Marnix ALLEGAERT et al.

It is certified that error appears in the above-indentified patent and that said Letters Patent is hereby corrected as shown below:

Column 9, line 28, Claim 1, "fending" should read --fencing--; and

Column 12, line 14, Claim 16, "rod" should read --rods--.

Signed and Sealed this

Eleventh Day of March, 1997

Bruce Lehman

*Attest:*

BRUCE LEHMAN

*Attesting Officer*

*Commissioner of Patents and Trademarks*